United States Patent [19]

Strauss

[11] 4,069,958

[45] Jan. 24, 1978

[54] DISPENSER

[76] Inventor: William Strauss, 2051 Clinton Road, Huntingdon Valley, Pa. 19006

[21] Appl. No.: 789,356

[22] Filed: Apr. 21, 1977

[51] Int. Cl.[2] ..... B26F 3/02

[52] U.S. Cl. ..... 225/16; 225/44; 242/55.53

[58] Field of Search ..... 225/10, 12, 13, 16, 225/44, 45, 52; 242/55.53

[56] References Cited

U.S. PATENT DOCUMENTS

| | | | |
|---|---|---|---|
| 837,939 | 12/1906 | Livermore | 225/16 |
| 1,347,867 | 7/1920 | Mitten | 242/55.53 |
| 3,021,987 | 2/1962 | Scholtz | 225/44 X |

*Primary Examiner*—J. M. Meister

*Attorney, Agent, or Firm*—Zachary T. Wobensmith, 2nd; Zachary T. Wobensmith, III

[57] ABSTRACT

A dispenser is provided for dispensing from a roll of tape or labels in a predetermined length, which dispenser includes an inner shell carrying a roll of tape or labels to be dispensed through an outlet opening, an outer housing rotatable for a limited distance with respect to the inner shell with an outlet opening for the tape or labels and an interposed friction lock for advancing the tape or labels for dispensing.

7 Claims, 7 Drawing Figures

FIG. 1
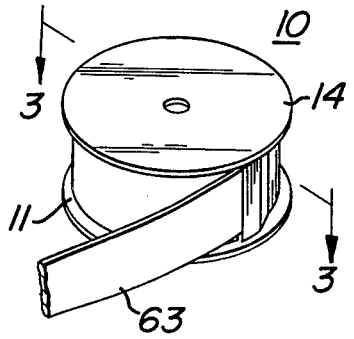
FIG. 3
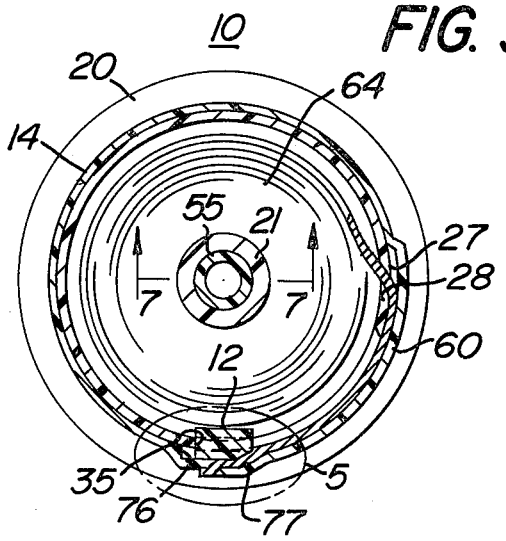
FIG. 2
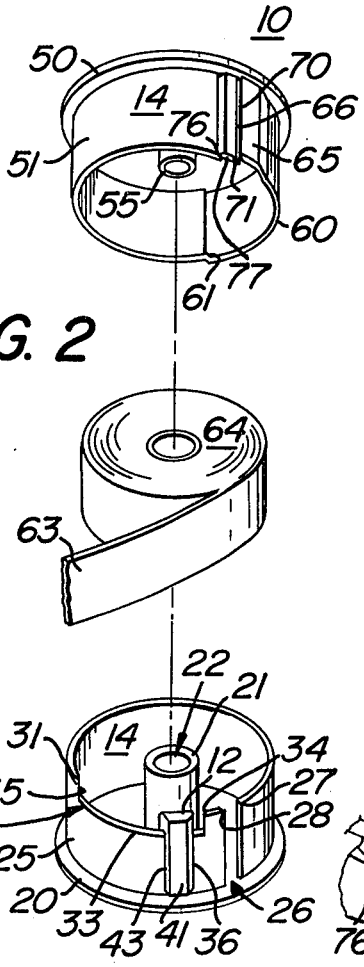
FIG. 4
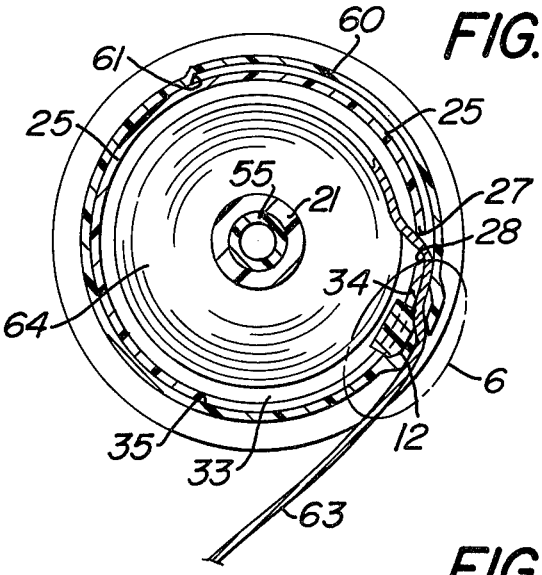
FIG. 5
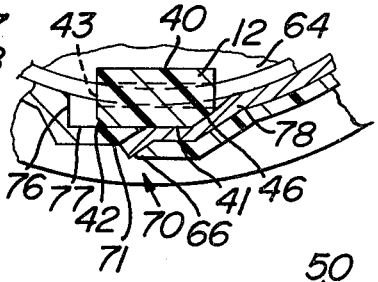
FIG. 6
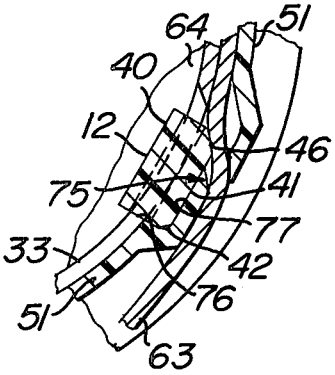
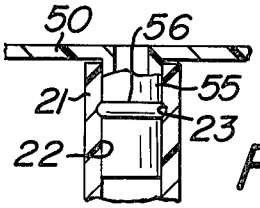
FIG. 7

DISPENSER

BACKGROUND OF THE INVENTION

1. Field of the Invention

This invention relates to a rotatable dispenser of the self-contained cartridge type which dispenses a predetermined length of tape.

2. Description of the Prior Art

There have been many variations of dispensers suggested providing tape or labels in a convenient self-contained package. Most of such dispensers include a roll of tape which must have a portion manually pulled therefrom and drawn across a serrated edge for separation with result that such tape, if it is adhesive coated, may stick to the user's fingers. In another typical tape or label dispenser, the labels are adhesive coated on one side and contained on a roll of paper which must be manually removed from the container and pulled against a serrated edge to separate a label or labels which then must be peeled from the backing paper. Such dispensers require a tab of tape to be available, are awkward to use, and do not possess controls to dispense a predetermined length of tape.

The dispenser of my invention is totally self-contained, can dispense either tape or labels of a predetermined length which can be varied when constructing the dispenser, and does not require the fingers of the user to pull the tape or labels from the dispenser.

SUMMARY OF THE INVENTION

This invention relates to a tape or label dispenser which has an inner shell carrying a roll of tape or labels, to be dispensed through an outlet opening, a friction lock over which the tape is carried and between it and an outer housing enclosing the shell and a friction lock, cooperating to dispense the predetermined length of tape by rotation, a limited distance of the outer housing relative to the inner shell.

The principle object of the invention is to provide a dispenser for a roll or tape or labels which dispenses the tape or labels by limited rotation of the outer housing.

A further object of the invention is to provide a dispenser for a roll of tape or labels, wherein the length of tape dispensed can be changed by varying the relative rotation of the outer housing.

A further object of the invention is to provide a dispenser for a roll of tape or labels which is simple and inexpensive to construct but is virtually foolproof in operation.

A further object of the invention is to provide a dispenser for a roll of tape or labels which can dispense a variety of types and sizes of tapes or labels merely by changing the dimensions of the inner shell and outer housing.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 1 is a perspective view of the dispenser in accordance with the invention;

FIG. 2 is an exploded perspective view of the dispenser of FIG. 1;

FIG. 3 is a horizontal sectional view, enlarged, taken approximately on the line 3—3 of FIG. 1 and showing the dispenser in one position;

FIG. 4 is a view similar to FIG. 3 but showing the dispenser in another position;

FIG. 5 is an enlarged view taken at location 5 of FIG. 3;

FIG. 6 is an enlarged view taken at location 6 of FIG. 4, and

FIG. 7 is a vertical sectional view taken approximately on the line 7—7 of FIG. 3.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the dispenser 10, as illustrated, is composed of three separate pieces, i.e. an inner shell 11, a friction lock 12 and an outer housing 14 all preferably of unit construction and moulded of synthetic plastic. The inner shell 11 includes a flat disc shaped bottom 20, with a cylindrical post 21 in the center thereof which post 21 has a central bore 22 with an annular groove 23 therein. The disc 20 has a cylindrical tube 25 extending perpendicularly therefrom, recessed from the edge of the disc 20 and with a tape outlet opening 26 therein extending its entire vertical height.

Referring to FIG. 3, the opening 26 is bounded by an edge 27 which has a slight bevel and by an edge 28 which has a considerably greater bevel thereon. The tube 25 is open at the end opposite to disc 20 with an upper boundary edge 30. The edge 30 extends substantially around the perimeter of tube 25 to a point 31 where it is interrupted by a cut-out portion 32 which provides a track 33 of predetermined length which extends to point 34 and which determines the length of the tape to be dispensed. The track 33 at point 31 is bounded by a vertical edge 35 that is beveled similarly to edge 28. The track at point 34 is also bounded by a vertical edge 36 that is beveled to a similar degree as edge 35 but in the opposite hand or direction. The track 33 carries the friction lock 12 which lock is of generally rectangular shape with flat inner wall 40 and outer wall 41 slightly beveled at its left edge 42 as seen in FIG. 5. The lock 12 has a flat upper wall and a vertical slot 43 which extends a portion of its length and fits over the inner wall 44 and outer wall 45 of the tube 25 to permit the lock to move along the predetermined length of the track 33 between the points 31 and 34. The lock 12 has a beveled edge 46 at its right hand terminus which bevel it at an acute angle with respect to the outer wall 41 as seen in FIGS. 5 and 6.

The outer housing 14 includes a flat disc 50 with a tube 51 extending perpendicularly therefrom substantially around the perimeter of the disc 50 but recessed from its perimeter edge.

The disc 50 has a post 55 in the center thereof which, in the assembled position, is received in the bore 22 in the post 21 and with an outer annular ring 56 which is received in the annular groove 23.

The tube 51 is of substantially cylindrical shape to fit over the tube 25 and has an outwardly offset concentric portion 60 which begins at point 61 and is spaced from the tube 25 a sufficient distance to permit the passage of tape 63 from a roll of tape 64 carried on post 21. The offset portion 60 extends around in a counterclockwise direction as seen in FIG. 4 to a further offset portion 65 which at edge 66 bounds a tape outlet opening 70.

The opening 70 is bounded by another offset portion 71 which is offset less than portion 65 and which with portion 65, forms a cavity 75 to receive the friction lock 12. The cavity 75 has an end wall 76 of a margin 77 in offset portion 71 and an inclined surface 78 in portion 65 which serves to define the terminal points of the cavity 75.

The mode of operation will now be pointed out.

A roll of tape or labels 64 is selected and placed in inner shell 11, the friction lock 12 is placed on track 33 at the extreme right hand end as seen in FIG. 2. A portion of tape 63 is pulled out through opening 26 and post 55 of outer housing 14 is pressed into bore 22 in post 21 with tape 63 passing through opening 70 and with lock 12 received in cavity 75.

The disc 20 is grasped in the fingers of one hand of the user and disc 50 grasped by the fingers of the other hand of the user and outer housing 14 rotated clockwise to the position shown in FIGS. 3 and 5. The tape 63 is caught between the surfaces 46 of lock 12 and 77 and a strip of tape is drawn from roll 64 until lock 12 strikes edge 35.

The disc 50 is rotated counterclockwise, the lock 12 moves out of frictional engagement with tape 64 and a strip of tape 63 passes out opening 70 in outer housing 14, with the length being determined by the length of track 33. The strip of tape or labels is pulled against the edge 66 and torn off. The outer housing 14 can be rotated clockwise and the operation repeated as desired.

It will thus be seen that apparatus has been provided with which the objects of the invention are achieved.

I claim:

1. A dispenser for dispensing a predetermined length of tape or labels from a roll which comprises an inner shell member which includes a disc, a cylindrical member extending from said disc and having a track portion extending around a part of said member, a connecting member extending from said disc, an outlet opening in said cylindrical member adjacent one end of said track portion, a friction lock member movable along said track portion, an outer housing member which includes a disc, an outer tubular member extending from said disc, and having a portion providing a cavity to contain said friction lock, said tubular member having an outwardly offset portion, an outlet opening from said cavity, and a connecting member extending from said outer housing disc which is engaged with said connecting member from said inner shell disc.

2. A dispenser as defined in claim 1 in which said connecting members are telescoping posts.

3. A dispenser as defined in claim 1 in which each of said inner shell, said friction lock and said outer housing is a single piece of synthetic plastic.

4. A dispenser as defined in claim 2 in which said post in said inner shell member includes a bore having an annular groove and said post in said outer housing has an outer annular ring which is received in the annular groove retaining the posts together.

5. A dispenser as defined in claim 1 in which said friction lock is of rectangular shape with an inner wall and an outer wall connected thereto and which extends over the track portion permitting the lock to slide therealong.

6. A dispenser as defined in claim 5 in which said outer housing tubular member has a margin and said friction lock has a beveled edge which acts with said margin to frictionally advance the tape for dispensing.

7. A dispenser as defined in claim 1 in which said outer housing member has a cutting edge along a margin of the outlet opening.

* * * * *